US009506429B2

(12) United States Patent
Peters et al.

(10) Patent No.: US 9,506,429 B2
(45) Date of Patent: Nov. 29, 2016

(54) SYSTEM AND METHOD FOR CONTROL OF FUEL INJECTOR SPRAY USING ULTRASONICS

(71) Applicant: CUMMINS INC., Columbus, IN (US)

(72) Inventors: Lester L. Peters, Columbus, IN (US); David L. Buchanan, Westport, IN (US); Vesa Hokkanen, Columbus, IN (US)

(73) Assignee: Cummins Inc., Columbus, IN (US)

( * ) Notice: Subject to any disclaimer, the term of this patent is extended or adjusted under 35 U.S.C. 154(b) by 711 days.

(21) Appl. No.: 13/915,481

(22) Filed: Jun. 11, 2013

(65) Prior Publication Data

US 2014/0360460 A1 Dec. 11, 2014

(51) Int. Cl.

| | |
|---|---|
| ***F02M 27/08*** | (2006.01) |
| ***F02D 41/30*** | (2006.01) |
| ***F02M 51/06*** | (2006.01) |
| ***F02D 41/38*** | (2006.01) |
| *F02D 41/20* | (2006.01) |
| *F02M 69/04* | (2006.01) |

(52) U.S. Cl.

CPC ..... *F02M 27/08* (2013.01); *F02D 41/3005* (2013.01); *F02D 41/38* (2013.01); *F02M 51/0603* (2013.01); *F02D 41/2096* (2013.01); *F02D 2041/389* (2013.01); *F02M 69/041* (2013.01); *F02M 2200/21* (2013.01)

(58) Field of Classification Search

CPC ..... F02M 27/08; F02M 51/0603; F02M 2200/21; F02D 41/38; F02D 41/3005; F02D 41/2096; F02D 2041/389

See application file for complete search history.

(56) References Cited

U.S. PATENT DOCUMENTS

| | | | |
|---|---|---|---|
| 4,466,571 | A | 8/1984 | Mühlbauer |
| 5,042,441 | A | 8/1991 | Paul et al. |
| 5,199,641 | A | 4/1993 | Hohm et al. |
| 5,619,969 | A | 4/1997 | Liu et al. |
| 5,983,863 | A | 11/1999 | Cavanagh et al. |
| 6,032,652 | A | 3/2000 | Nozawa et al. |
| 6,199,533 | B1 | 3/2001 | Morris et al. |
| 6,659,365 | B2 | 12/2003 | Gipson et al. |
| 6,663,027 | B2 | 12/2003 | Jameson et al. |
| 7,334,741 | B2 | 2/2008 | Benson et al. |
| 7,819,335 | B2 | 10/2010 | Ehlert et al. |
| 7,918,211 | B2 | 4/2011 | McNichols et al. |
| 8,028,930 | B2 | 10/2011 | Ehlert et al. |

(Continued)

FOREIGN PATENT DOCUMENTS

| | | |
|---|---|---|
| GB | 1 556 998 | 12/1979 |
| GB | 2 077 351 A | 12/1981 |

OTHER PUBLICATIONS

Douglas Baker et al., "Forced Frequency Excitation of Intermittent High Pressure Nozzle Flows for Improved Atomization and Air Entrainment Characteristics", SAE 07PFL-653, (2007).

*Primary Examiner* — Hieu T Vo
*Assistant Examiner* — Arnold Castro
(74) *Attorney, Agent, or Firm* — Faegre Baker Daniels LLP

(57) ABSTRACT

The present disclosure provides an improved system and method of operating a fuel injector of an engine to provide at least two different types of fuel spray in a combustion chamber of the engine by application of ultrasonic pulses to fuel in the fuel injector during an injection event. A first type of spray includes larger droplets that reduce the effective diffusion combustion area around the droplets and a second type of spray includes relatively small droplets that increase the effective diffusion combustion area around the droplets.

21 Claims, 3 Drawing Sheets

(56) References Cited

U.S. PATENT DOCUMENTS

2003/0066899 A1* 4/2003 Gipson ..... B05B 17/0623 239/5
2007/0170276 A1* 7/2007 McNichols ..... F02M 47/027 239/102.2
2007/0170278 A1* 7/2007 McNichols ..... F02M 47/027 239/102.2
2008/0121736 A1 5/2008 Mao et al.
2009/0057438 A1* 3/2009 Hofbauer ..... F02M 69/041 239/102.2
2009/0108095 A1* 4/2009 Ruiz ..... F02M 47/027 239/102.1

* cited by examiner

SYSTEM AND METHOD FOR CONTROL OF FUEL INJECTOR SPRAY USING ULTRASONICS

TECHNICAL FIELD

This disclosure relates to a fuel injector including an ultrasonic exciter positioned proximate or adjacent to a nozzle element cavity of the fuel injector, and the use of the ultrasonic exciter to provide control over a spray of fuel from the fuel injector into an associated combustion chamber.

BACKGROUND

A variety of techniques have been developed to control fuel flow into a combustion chamber of an internal combustion engine. These techniques are generally described as rate shaping techniques, which provide varying methods of controlling rates of fuel flow into a combustion chamber. By reducing the rate of fuel flow during an initial portion of an injection event, $NO_x$ formation is reduced. The fuel flow rate is then increased or unrestricted during the latter portion of the injection event. However, dividing an injection event into a first portion with a first fuel flow rate and a second portion with a second, higher fuel flow rate increases the total length of an injection event, which increases fuel consumption and decreases engine efficiency.

SUMMARY

This disclosure provides a fuel system for supplying a fuel to a combustion chamber of an internal combustion engine. The fuel system comprises a fuel injector and a controller. The fuel injector includes an actuator, an injector body having a longitudinal axis, a nozzle housing, a fuel injector cavity, a nozzle valve element, and an ultrasonic exciter system. The nozzle housing is secured to the injector body and includes at least one injector orifice in communication with the combustion chamber. The nozzle valve element extends longitudinally along the fuel injector. The actuator is adapted to receive an injection signal and to cause movement of the nozzle valve element in response to the injection signal to permit fuel flow from the injector cavity through the at least one injector orifice to the combustion chamber to form an injection event. The ultrasonic exciter system is positioned in the fuel injector cavity and is adapted to receive an ultrasonic actuation signal and to generate ultrasonic vibrations in the fuel injector cavity in response to the ultrasonic actuation signal. The controller is adapted to generate the injection signal to initiate the injection event at a first time and the controller is adapted to generate the ultrasonic actuation signal to cause the ultrasonic exciter system to ultrasonically vibrate the fuel at a second time during the injection event and later than the first time.

This disclosure also provides a method of adjusting a fuel spray from a fuel injector into a combustion chamber of an internal combustion engine. The method comprises generating an injection signal and an ultrasonic actuation signal, receiving the injection signal and beginning an injection event at a first time in response to the injection signal, and receiving the ultrasonic actuation signal during the injection event and generating ultrasonic vibrations in the fuel at a second time later than the first time in response to the ultrasonic actuation signal.

This disclosure also provides a method of adjusting a fuel spray from a fuel injector into a combustion chamber of an internal combustion engine. The method comprises generating an injection signal and an ultrasonic actuation signal, receiving the injection signal and beginning an injection event at a first time in response to the injection signal, the injection event having a first pulse width, and receiving the ultrasonic actuation signal and generating ultrasonic vibrations in response to the ultrasonic actuation signal. The ultrasonic vibrations begin at a second time later than the first time and prior to the end of the first pulse width, and the ultrasonic vibrations have a second pulse width.

Advantages and features of the embodiments of this disclosure will become more apparent from the following detailed description of exemplary embodiments when viewed in conjunction with the accompanying drawings.

DETAILED DESCRIPTION

Figure 1:
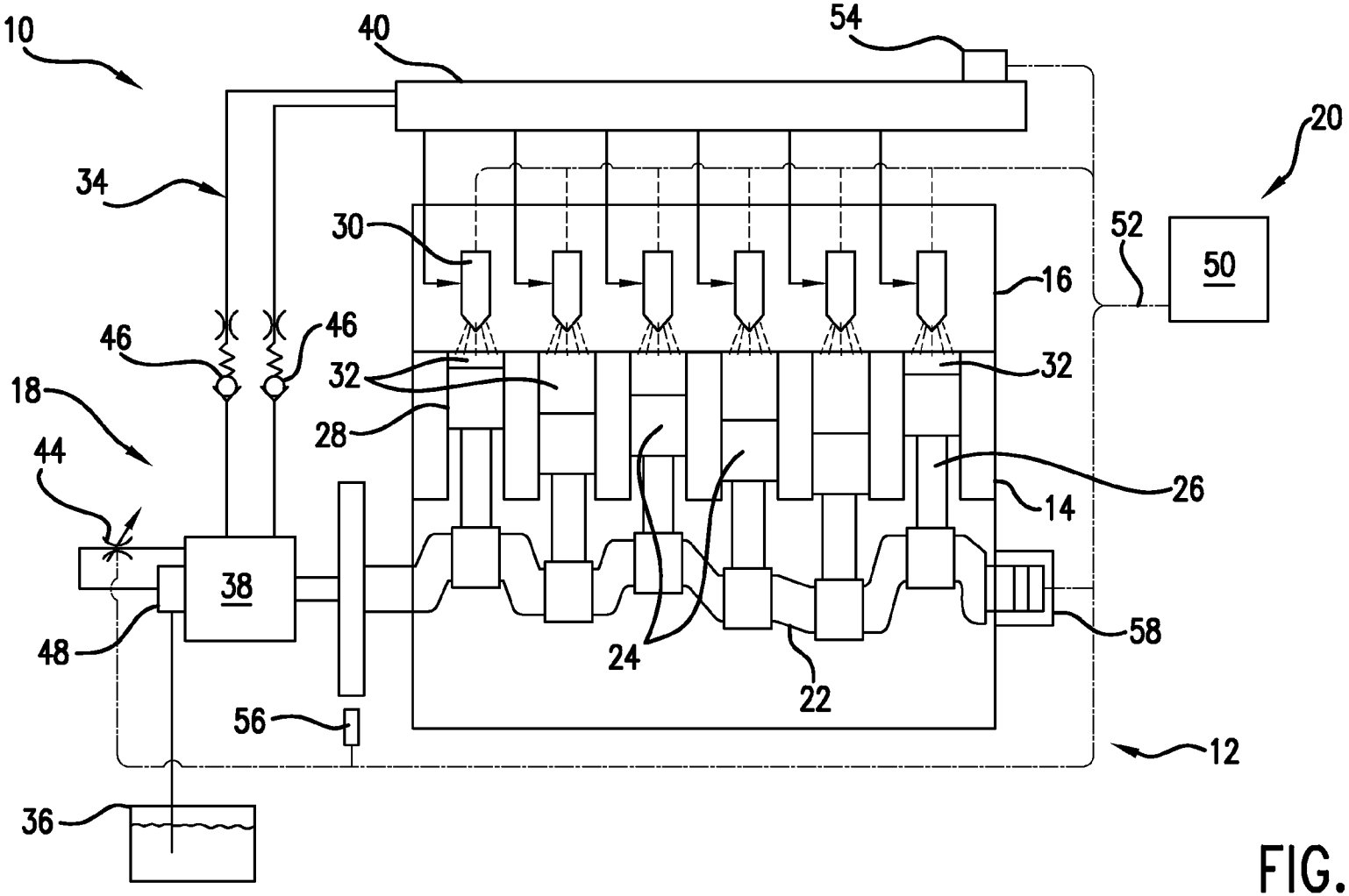
FIG. 1 is a schematic of an internal combustion engine incorporating a first exemplary embodiment of the present disclosure.

Referring to FIG. 1, a portion of an internal combustion engine in accordance with a first exemplary embodiment of the present disclosure is shown as a simplified schematic and generally indicated at 10. Engine 10 includes an engine body 12, which includes an engine block 14 and a cylinder head 16 attached to engine block 14, a fuel system 18, and a control system 20. Control system 20 receives signals from sensors located on engine 10 and transmits control signals to devices located on engine 10 to control the function of those devices, such as one or more fuel injectors. While engine 10 works well for its intended purpose, one challenge that continues to face engine designs is the need to cost-effectively increase the efficiency of engine 10. The present disclosure provides an improved system and method of operating the fuel injectors of engine 10 to provide at least two different types of fuel spray in the combustion chambers of engine 10. A first type of spray includes larger droplets that reduce the effective diffusion combustion area around the droplets, which slows the rate of combustion while maintaining a substantially constant fuel injection rate or fuel flow rate. A second type of spray includes relatively small droplets that increase the effective diffusion combustion area around the droplets. The larger droplets reduce $NO_x$ formation while maintaining a high rate of combustion. The smaller droplets function to burn particulate matter, but due to reduced oxygen and the presence of combustion products such as $CO_2$ formed during combustion of the larger droplets, $NO_x$ production is minimized. The reduction in $NO_x$ is possible while improving fuel efficiency as compared to rate-shaping techniques because in rate-shaping techniques the fuel flow rate is increased with increases in pressure, and in contrast the present disclosure provides for a system and method that maintain the fuel flow rate from the beginning to the end of an injection event, which enables maintaining a length of injection similar to a conventional, non-rate shaped fuel injector. Examples of rate-shaping systems and methods are described in U.S. Pat. Nos. 5,619, 969, 5,983,863, 6,199,533, and 7,334,741. Another technique for providing the benefits similar to that of the present disclosure is to provide a constant fuel flow rate while varying fuel flow pressure. Further details regarding the use and implementation a fuel injector having the capability of providing a constant fuel flow rate with a variable pressure in the fuel injector is set forth in detail in co-pending patent application Ser. No. 13/915,305 titled "System and Method for Control of Fuel Injector Spray," filed on Jun. 11, 2013, the entire content of which is hereby incorporated by reference.

Engine body 12 includes a crank shaft 22, a plurality of pistons 24, and a plurality of connecting rods 26. Pistons 24 are positioned for reciprocal movement in a plurality of engine cylinders 28, with one piston positioned in each engine cylinder 28. One connecting rod 34 connects each piston 24 to crank shaft 22. As will be seen, the movement of the pistons under the action of a combustion process in engine 10 causes connecting rods 26 to move crankshaft 22.

A plurality of fuel injectors 30 are positioned within cylinder head 16. Each fuel injector 30 is fluidly connected to a combustion chamber 32, each of which is formed by one piston 24, cylinder head 14, and the portion of engine cylinder 28 that extends between a respective piston 24 and cylinder head 14.

Fuel system 18 provides fuel to injectors 30, which is then injected into combustion chambers 32 by the action of fuel injectors 30, forming one or more injection events. Fuel system 18 includes a fuel circuit 34, a fuel tank 36, which contains a fuel, a high-pressure fuel pump 38 positioned along fuel circuit 34 downstream from fuel tank 36, and a fuel accumulator or rail 40 positioned along fuel circuit 34 downstream from high-pressure fuel pump 38. While fuel accumulator or rail 40 is shown as a single unit or element, accumulator 40 may be distributed over a plurality of elements that transmit or receive high-pressure fuel, such as fuel injector(s) 30, high-pressure fuel pump 38, and any lines, passages, tubes, hoses and the like that connect high-pressure fuel to the plurality of elements. Injectors 30 receive fuel from fuel accumulator 40. Fuel system 18 may further include an inlet metering valve 44 positioned along fuel circuit 34 upstream from high-pressure fuel pump 38 and one or more outlet check valves 46 positioned along fuel circuit 34 downstream from high-pressure fuel pump 38 to permit one-way fuel flow from high-pressure fuel pump 38 to fuel accumulator 40. Though not shown, additional elements may be positioned along fuel circuit 34. For example, inlet check valves may be positioned downstream from inlet metering valve 44 and upstream from high-pressure fuel pump 38, or inlet check valves may be incorporated in high-pressure fuel pump 38. Inlet metering valve 44 has the ability to vary or shut off fuel flow to high-pressure fuel pump 38, which thus shuts off fuel flow to fuel accumulator 40. Fuel circuit 34 connects fuel accumulator 40 to fuel injectors 30, which then provide controlled amounts of fuel to combustion chambers 32. Fuel system 18 may also include a low-pressure fuel pump 48 positioned along fuel circuit 34 between fuel tank 36 and high-pressure fuel pump 38. Low-pressure fuel pump 48 increases the fuel pressure to a first pressure level prior to fuel flowing into high-pressure fuel pump 38, which increases the efficiency of operation of high-pressure fuel pump 38.

Control system 20 may include a controller or control module 50 and a wire harness 52. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions (software), such as logical blocks, program modules etc. being executed by one or more processors (e.g., one or more microprocessor, a central processing unit (CPU), and/or application specific integrated circuit), or by a combination of both. For example, embodiments can be implemented in hardware, software, firmware, middleware, microcode, or any combination thereof. The instructions can be program code or code segments that perform necessary tasks and can be stored in a machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control system 20 may also include an accumulator pressure sensor 54 and a crank angle sensor. While sensor 54 is described as being a pressure sensor, sensor 54 may be other devices that may be calibrated to provide a pressure signal that represents fuel pressure, such as a force transducer, strain gauge, or other device. The crank angle sensor may be a toothed wheel sensor 56, a rotary Hall sensor 58, or other type of device capable of measuring the rotational angle of crankshaft 22. Control system 20 uses signals received from accumulator pressure sensor 54 and the crank angle sensor to determine the combustion chamber receiving fuel, which is then used to analyze the signals received from accumulator pressure sensor 54.

Control module 50 may be an electronic control unit or electronic control module (ECM) that may monitor conditions of engine 10 or an associated vehicle in which engine 10 may be located. Control module 50 may be a single processor, a distributed processor, an electronic equivalent of a processor, or any combination of the aforementioned elements, as well as software, electronic storage, fixed lookup tables and the like. Control module 50 may include a digital or analog circuit. Control module 50 may connect to certain components of engine 10 by wire harness 52, though such connection may be by other means, including a wireless system. For example, control module 50 may connect to and provide control signals to inlet metering valve 44 and to fuel injectors 30.

When engine 10 is operating, combustion in combustion chambers 32 causes the movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 is measured by engine 10 to aid in timing of combustion events in engine 10 and for other purposes. The angle of rotation of crankshaft 22 may be measured in a plurality of locations, including a main crank pulley (not shown), an engine flywheel (not shown), an engine camshaft (not shown), or on the camshaft itself. Measurement of crankshaft 22 rotation angle may be made with toothed wheel sensor 56, rotary Hall sensor 58, and by other techniques. A signal representing the angle of rotation of crankshaft 22, also called the crank angle, is transmitted from toothed wheel sensor 56, rotary Hall sensor 58, or other device to control system 20.

Crankshaft 22 drives high-pressure fuel pump 38 and low-pressure fuel pump 48. The action of low-pressure fuel pump 48 pulls fuel from fuel tank 36 and moves the fuel along fuel circuit 34 toward inlet metering valve 44. From inlet metering valve 44, fuel flows downstream along fuel circuit 34 through inlet check valves (not shown) to high-pressure fuel pump 38. High-pressure fuel pump 38 moves the fuel downstream along fuel circuit 34 through outlet check valves 46 toward fuel accumulator or rail 40. Inlet metering valve 44 receives control signals from control system 20 and is operable to block fuel flow to high-pressure fuel pump 38. Inlet metering valve 44 may be a proportional valve or may be an on-off valve that is capable of being rapidly modulated between an open and a closed position to adjust the amount of fuel flowing through the valve.

Fuel pressure sensor 54 is connected with fuel accumulator 40 and is capable of detecting or measuring the fuel pressure in fuel accumulator 40. Fuel pressure sensor 54 sends signals indicative of the fuel pressure in fuel accumulator 40 to control system 20. Fuel accumulator 40 is connected to each fuel injector 30. Control system 20 provides control signals to fuel injectors 30 that determines operating parameters for each fuel injector 30, such as the length of time fuel injectors 30 operate and the number of fueling pulses per a firing or injection event period, which determines the amount of fuel delivered by each fuel injector 30.

Figure 2:
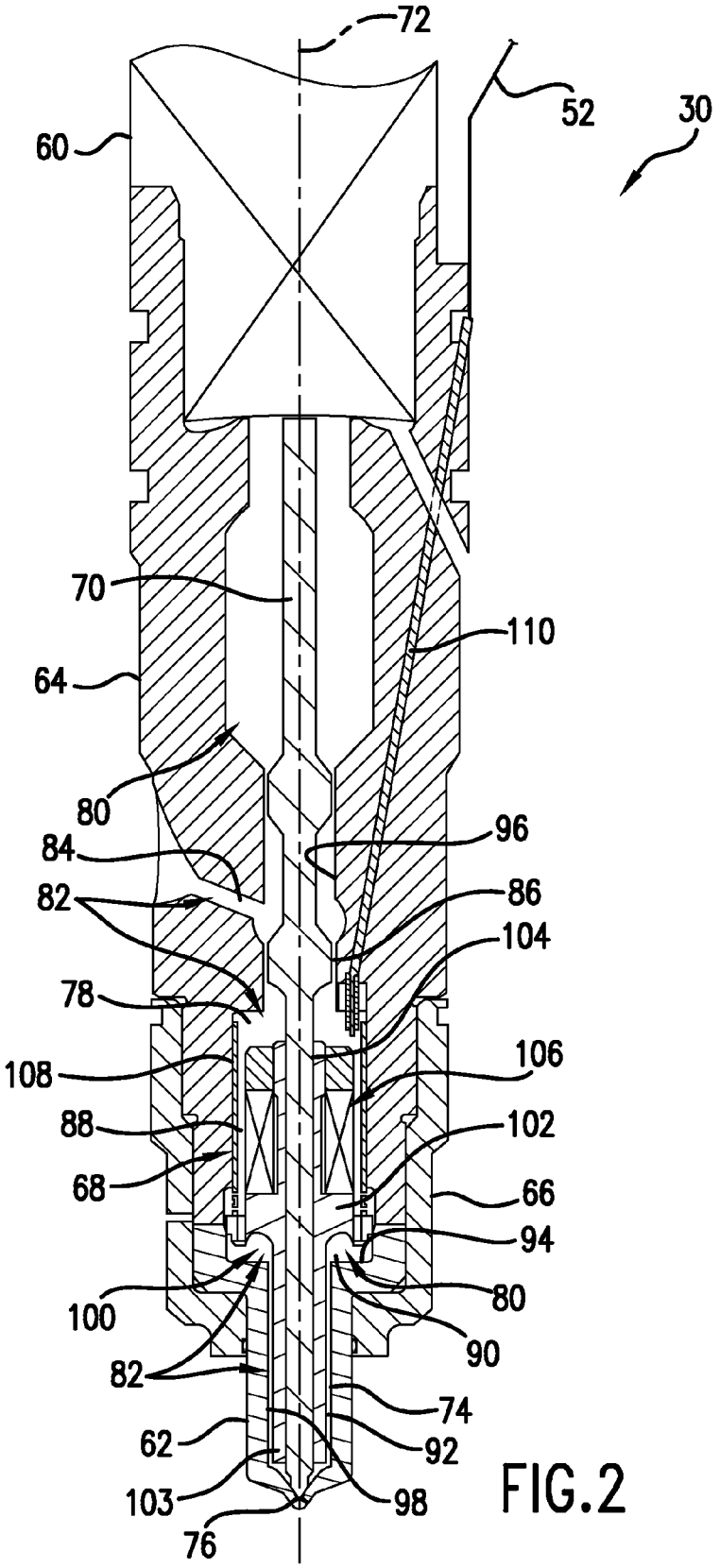
FIG. 2 is a cross-sectional view of a fuel injector of the engine of FIG. 1.

Turning now to FIG. 2, a portion of fuel injector 30 is shown in a sectional view. Fuel injector 30 includes an actuator portion 60, a nozzle housing 62, an injector body 64, a retainer 66, an ultrasonic exciter assembly 68, a nozzle valve element 70, a longitudinal axis 72, and a fuel delivery circuit 82. Actuator portion 60 is connected to nozzle housing 62. In the first exemplary embodiment, nozzle housing 62 is attached to injector body 64 by retainer 66. Actuator portion 60, nozzle housing 62, injector body 64, and retainer 66 are positioned along longitudinal axis 72. Nozzle housing 62 includes a nozzle element cavity 74, which extends longitudinally along axis 72, and at least one injector orifice 76 positioned in a distal end of nozzle housing 62. Nozzle housing 62 further includes an interior surface 98 and a transversely extending interior surface 94. Injector body 64 includes a longitudinally extending interior surface 96 that forms a body cavity 78. Nozzle valve element 70 is positioned for reciprocal movement in body cavity 78 and nozzle element cavity 74. Ultrasonic exciter assembly 68 may be similar to ultrasonic waveguide 121 described in U.S. Pat. Nos. 7,918,211 and 8,028,930, each of which is hereby incorporated by reference in its entirety.

Actuator portion 60 is adapted to receive an injection signal generated by controller 50. In response to the injection signal, actuator portion 60, which may include a solenoid, a piezoelectric actuator, a valve portion, or other mechanism adapted to cause reciprocal movement of nozzle valve element 70, causes nozzle valve element 70 to move longitudinally along axis 72 in a direction that is away from an interior surface of nozzle housing 62. The movement of nozzle valve element 70 permits fuel in nozzle element cavity 74 to flow through injector orifice(s) 76 into an associated combustion chamber 32. To end the injection event, actuator portion 60 is de-energized, which permits nozzle valve element 70 to move longitudinally toward the interior surface of nozzle housing 62, blocking fuel flow through injector orifice(s) 76, which ends the fuel injection event. As will be described further hereinbelow, the fuel injection event is initiated or begins at a first time and extends for a length of time to form an injection event. The time during which the injection event extends is an injection event pulse width.

Fuel injector 30 further includes an ultrasonic exciter system 100. Ultrasonic exciter system 100 is positioned in a fuel injector cavity 80, which in the exemplary embodiment includes nozzle element cavity 74 and body cavity 78, and extends along longitudinal axis 72. Ultrasonic exciter system 100 is adapted to receive an ultrasonic exciter system actuation signal, which may be called an ultrasonic actuation signal, generated by controller 50, which may be by way of wiring harness 52. In response to the ultrasonic exciter system actuation signal, ultrasonic exciter system 100 begins expanding and contracting in a longitudinal direction at an ultrasonic frequency. As described further hereinbelow, the introduction of ultrasonic vibrations into a fuel located in nozzle housing 62 causes a spray of fuel flowing into combustion chamber 32 to be modified for a beneficial effect on the combustion process in combustion chamber 32.

Ultrasonic exciter system 100 includes an ultrasonic horn 102, which includes a longitudinal portion 103 and a longitudinally extending central opening 104. Ultrasonic horn 102 is positioned to be immediately upstream from nozzle housing 62. In the exemplary embodiment, central opening 104 is sized and positioned to receive nozzle valve element 70 and to permit nozzle valve element 70 to move freely with respect to ultrasonic horn 102. A piezoelectric transducer assembly 106 is positioned on a proximate end of ultrasonic horn 102. A body insulator 108 is positioned between piezoelectric transducer assembly 106 and an interior of injector body 64. An electrical connection 110 connects wiring harness 52 to piezoelectric transducer assembly 106. When ultrasonic exciter system 100 receives the ultrasonic exciter system actuation signal generated by controller 50 of control system 20, ultrasonic horn portion 102 moves or oscillates longitudinally rapidly, causing vibrations in fuel positioned between ultrasonic horn portion 102 and the interior of nozzle housing 62. These vibrations modify the characteristics of fuel that flows through injector orifices 76 into combustion chamber 32, described further hereinbelow.

Fuel delivery circuit 82 includes a fuel inlet 84, which is adapted or configured to receive fuel from fuel circuit 34 of fuel system 18, a first radial passage 86 located radially between an exterior surface of nozzle valve element 70 and injector body interior surface 96, body cavity 78, second radial passage 88 located radially between piezoelectric transducer assembly 106 and body insulator 108, a cavity portion 90 positioned longitudinally between ultrasonic horn 102 and a transversely extending interior surface 94 of nozzle housing 64, and an element passage 92 located between an exterior peripheral portion of longitudinal portion 103 and interior surface 98 of nozzle housing 62. During an injection event, fuel flows from fuel system 18 through fuel delivery circuit 82 to injector orifices 76. Fuel flows from fuel circuit 34 into fuel inlet 84, and then into fuel injector cavity 80. The fuel flows distally along fuel injector cavity 80, through first radial passage 86, and then through second radial passage 88. Once through second radial passage 88, fuel flows into cavity portion 90. When ultrasonic exciter system 100 is energized, the vibrations caused by ultrasonic exciter system 100 are induced in the fuel in cavity portion 90. The fuel in cavity portion 90 flows through element passage 92 to the distal end of nozzle element cavity 74, where the fuel is then able to flow through injector orifice(s) 76 during an injection event.

Figure 3:
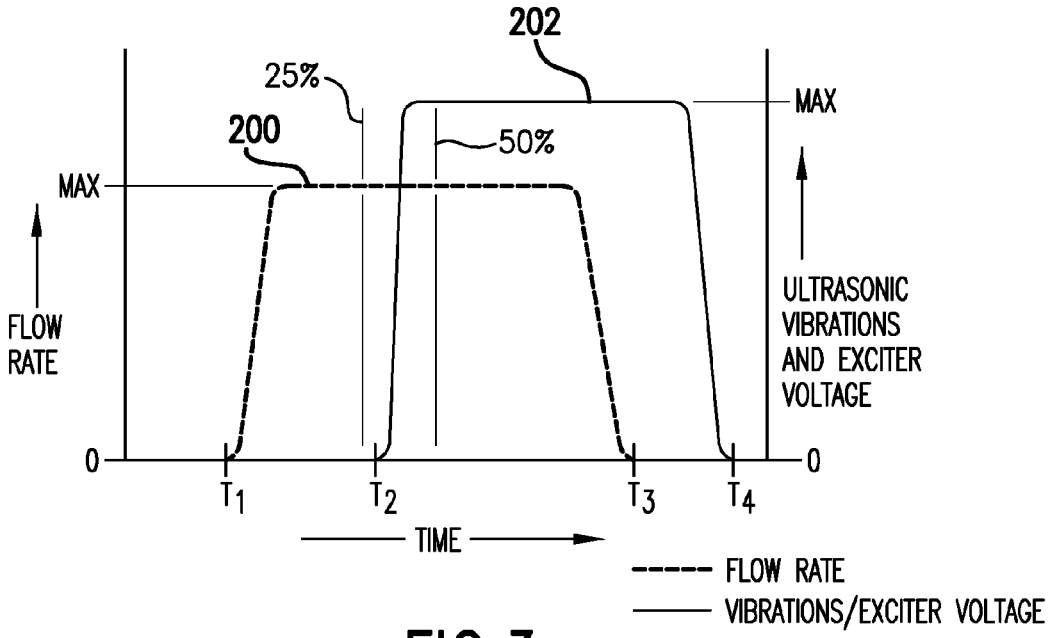
FIG. 3 is a graph showing operation of an ultrasonic actuator of the engine of FIG. 1.

Turning now to FIG. 3, a graph representing the first exemplary embodiment of the present disclosure is presented. The horizontal axis represents time and the left vertical axis represents the fuel flow rate through injector orifice(s) 76. The right vertical axis represents the ultrasonic exciter system actuation signal, which also corresponds with ultrasonic vibration of the fuel in fuel injector 30 by ultrasonic exciter system 100. The ultrasonic exciter system actuation signal is a voltage signal needed to actuate or energize ultrasonic exciter system 100. A first curve 200 represents the fuel flow rate from fuel injector 30 into combustion chamber 32 during an injection event. The injection event begins at a first time T1 and extends for a length of time to form a first pulse width. A second curve 202 represents the voltage applied to ultrasonic exciter system 100 as well as the pulse width of vibrations caused by the ultrasonic exciter system actuation signal, which are initiated at or begin at a second time T2 that is later than first time T1. In an exemplary embodiment, second time T2 occurs at a time that is at least 25% of the first pulse width after first time T1.

T1. In another exemplary embodiment, second time T2 is in the range of 25% to 50% of the first pulse width after first time T1. In the first exemplary embodiment, the fuel in fuel injector 30 is ultrasonically vibrated for a time that extends beyond an end of the injection event represented by first curve 200. Thus, voltage will be applied to ultrasonic exciter system 100 for about 50% to 75% of the injection event and second curve 202 thus overlaps first curve 200 for 50% to 75% of the first pulse width, which means that vibrations from ultrasonic exciter system 100 will overlap the injection event for about 50% to 75% of the injection event. It should be noted that second curve 202 represents application of the ultrasonic exciter system actuation signal to ultrasonic exciter system 100 and the vibrations generated by that voltage, which occur almost simultaneously with application of that signal. The actual signal applied to ultrasonic exciter system 100 is a high frequency alternating voltage that causes ultrasonic exciter system 100 to expand and contract. The oscillating voltage has been simplified to second curve 202 for clarity.

The injection event ends at a time T3. Thus, the first pulse width extends from T1 to T3 and represents an injection event that is considered to be a constant fuel flow rate injection event because the fuel flow remains constant from a point shortly after the injection event begins at T1 until a time shortly before the injection event ends at T3. Application of the ultrasonic exciter system actuation signal to ultrasonic exciter system 100 ends at a time T4, as well as the vibrations caused by ultrasonic exciter system 100. Thus, ultrasonic exciter system actuation signal is applied to ultrasonic exciter system 100 for a second pulse width that extends from T2 to T4, which corresponds with the pulse width of ultrasonic vibrations in the fuel in fuel injector 30.

Because a single controller, such as controller 50, may be used to power multiple ultrasonic exciter systems 100 in engine 10, it is advantageous to turn the signal off to any ultrasonic exciter system 100 that is associated with a non-operating fuel injector. The reason is that powering a single ultrasonic exciter system 100 requires less power, improving the efficiency of engine 10, and reduces heat generated by powering any one ultrasonic exciter system 100 more than is necessary for the benefits described herein. Because the ultrasonic exciter system actuation signal to ultrasonic exciter system 100 is turned off shortly after the end of an injection event in the first exemplary embodiment, and because the second pulse width begins after the start of the first pulse after a delay that is approximately one quarter to one half the first pulse width, the second pulse width is shorter than the first pulse width.

While the flow of fuel into combustion chamber 32 is constant during an injection event, the fuel flow into combustion chamber 32 is different before and after ultrasonic exciter system 100 is energized. From time T1 to Time T2, which is in the range of 25% to 50% of the first pulse width, fuel flow from fuel injector 30 into combustion chamber 32 is characterized by larger droplets that reduce the effective diffusion combustion area around the droplets. The larger droplets reduce $NO_x$ formation while maintaining a high rate of combustion. However, the larger droplets also cause generation of particulate matter, also called soot or smoke, when it exits an exhaust system. When ultrasonic exciter system 100 is energized at time T2, the high frequency pulsations in nozzle element cavity 74 serve to cause the fuel entering combustion chamber 32 to form small, fine droplets or a mist, which increases the effective diffusion combustion area around the droplets. The smaller droplets function to burn particulate matter, but due to reduced oxygen and combustion products such as $CO_2$, which are formed during combustion of the larger droplets, $NO_x$ production is minimized. Thus, the system of the present disclosure provides substantially improved combustion of fuel in combustion chambers 32 that is similar in results to rate varying systems, but without the need to generate extremely high pressures and to vary pressures between a lower level, which creates larger fuel droplets, and a higher level, which creates smaller fuel droplets. For example, in fuel flow rate varying systems a high pressure may be 2500 bar or more, and this pressure is varied in a nozzle element cavity from a low of 1000 bar to the high pressure. In the system of the present disclosure, the injection pressure may constant, for example 1000 bar, to achieve similar results to rate varying systems.

Figure 4:
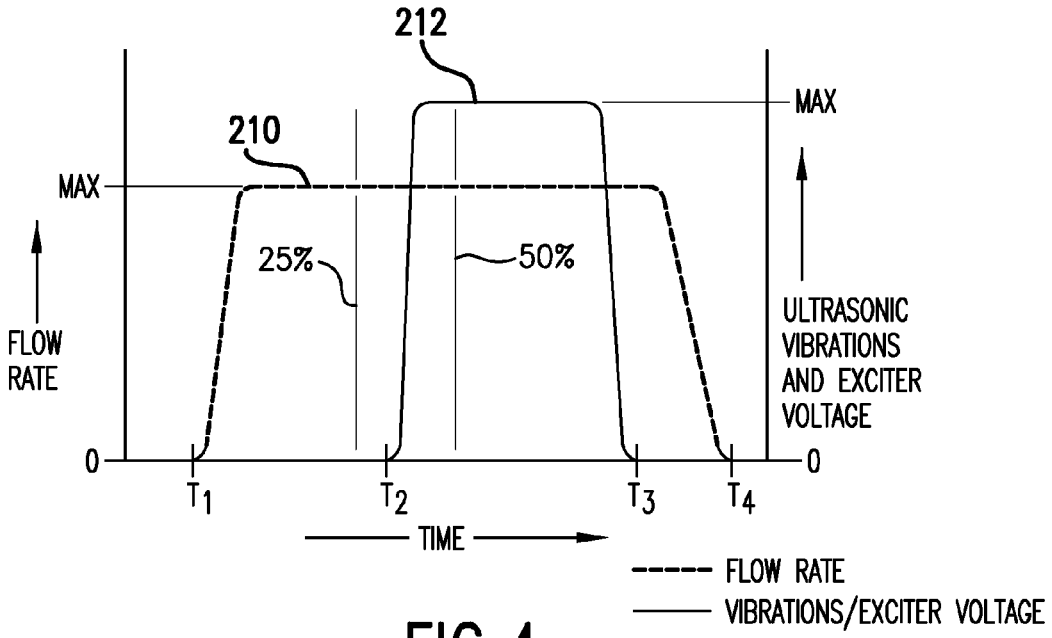
FIG. 4 is a graph showing operation of an ultrasonic actuator of the engine of FIG. 1 in accordance with a second exemplary embodiment of the present disclosure.

Turning now to FIG. 4, a graph in accordance with a second exemplary embodiment of the present disclosure is presented. The second As with FIG. 3, the horizontal axis represents time and the left vertical axis represents the fuel flow rate through injector orifice(s) 76. The right vertical axis represents the ultrasonic exciter system actuation signal, which is a voltage signal needed to actuate ultrasonic exciter system 100, as well as the vibrations caused by ultrasonic exciter system 100 in a fuel in fuel injector 30. A first curve 210 represents the fuel flow rate from fuel injector 30 into combustion chamber 32 during an injection event. The injection event begins at a first time T1 and extends for a length of time to form a first pulse width. A second curve 212 that represents voltage applied to ultrasonic exciter system 100 and the vibrations generated nearly simultaneously by the application of that voltage begins at a second time T2 that is later than first time T1. In an exemplary embodiment, second time T2 occurs at a time that is at least 25% of the first pulse width after first time T1. In another exemplary embodiment, second time T2 is in the range of 25% to 50% of the first pulse width after first time T1. In the second exemplary embodiment, the ultrasonic exciter system actuation signal is applied to ultrasonic exciter system 100, and the fuel in the fuel injector is ultrasonically vibrated, until a time T3 that is shorter than the duration of the injection event. As with second curve 202, second curve 212 represents the signal or voltage applied to ultrasonic exciter system 100 as well as the vibrations generated nearly simultaneously in the fuel in fuel injector 30 by the application of the ultrasonic exciter system actuation signal to ultrasonic exciter system 100. The actual signal is a high frequency alternating voltage that causes ultrasonic exciter system 100 to expand and contract. The oscillating voltage has been simplified to second curve 212 for clarity.

The injection event ends at a time T4. Thus, the first pulse width extends from T1 to T4 and represents an injection event that is considered to be a constant fuel flow rate injection event because the fuel flow remains constant from a point shortly after the injection event begins at T1 until a time shortly before the injection event ends at T4. Application of the ultrasonic exciter system actuation signal to ultrasonic exciter system 100 ends at time T3, which ends the vibrations in the fuel in fuel injector 30. Thus, ultrasonic exciter system actuation signal is applied to ultrasonic exciter system 100 for a second pulse width that extends from T2 to T3, which corresponds with ultrasonic vibration of the fuel in the fuel injector.

As with the first exemplary embodiment, it is advantageous to turn the signal off to any ultrasonic exciter system 100 that is associated with a non-operating fuel injector. Because the ultrasonic exciter system actuation signal to ultrasonic exciter system 100 is turned off before the end of an injection event in the second exemplary embodiment, and because the second pulse width begins after the start of the first pulse after a delay that is approximately one quarter to one half the first pulse width, the second pulse width is shorter than the first pulse width.

While the flow of fuel into combustion chamber 32 is constant during an injection event, the fuel flow into combustion chamber 32 is different before and after ultrasonic exciter system 100 is energized. From time T1 to Time T2, which is in the range of 25% to 50% of the first pulse width, fuel flow from fuel injector 30 into combustion chamber 32 is characterized by larger droplets that reduce the effective diffusion combustion area around the droplets, providing the benefits described for the first exemplary embodiment. When ultrasonic exciter system 100 is energized at time T2, the high frequency pulsations in nozzle element cavity 74 serve to cause the fuel entering combustion chamber 32 to form small, fine droplets or a mist, which increases the effective diffusion combustion area around the droplets, providing the benefits described for the first exemplary embodiment. Thus, the system of the present disclosure provides substantially improved combustion of fuel in combustion chambers 32 that is similar in results to rate varying systems, but without the need to generate extremely high pressures and to vary pressures between a lower level, which creates larger fuel droplets, and a higher level, which creates smaller fuel droplets. In the second exemplary embodiment, the signal to ultrasonic exciter system 100 is turned off at time T3, which then permits formation of larger fuel droplets near the end of an injection event. However, because the formation of larger fuel droplets occurs near the end of the injection event, the presence of large and small droplets provides the opportunity to modify a balance between NOx formation and particulate formation, which may be beneficial to engine 10 depending on the capabilities of an after-treatment system (not shown) of engine 10.

While not shown in the figures, it should be apparent that voltage may be applied to ultrasonic exciter system 100 prior to the beginning of an injection event. However, the previously described benefits of ultrasonic exciter system 100 would thus be reduced at the beginning of an injection event, unless the amplitude or frequency of ultrasonic vibrations was modified to manipulate characteristics of fuel flow into combustion chamber(s) 32. For example, the amplitude of the ultrasonic vibrations may be of such a small value as to provide minimal vibrations to fuel within fuel injector 30, which would be approximately equivalent to no ultrasonic vibrations. Furthermore, the amplitude may be modulated during the injection event to vary the combustion rate throughout the injection event to optimize combustion and reduce the creation of undesirable emissions, such as $NO_x$.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel system for supplying a fuel to a combustion chamber of an internal combustion engine, the system comprising:

a fuel injector including an injector body having a longitudinal axis, a nozzle housing secured to the injector body and including at least one injector orifice in communication with the combustion chamber, a fuel injector cavity, a nozzle valve element extending longitudinally along the fuel injector, an actuator adapted to receive an injection signal and to cause movement of the nozzle valve element in response to the injection signal to permit fuel flow from the injector cavity through the at least one injector orifice to the combustion chamber to form an injection event, and an ultrasonic exciter system positioned in the fuel injector cavity and adapted to receive an ultrasonic actuation signal and to generate ultrasonic vibrations in the fuel injector cavity in response to the ultrasonic actuation signal, and movement of the nozzle valve element is independent of the ultrasonic actuation signal; and a controller adapted to generate and transmit the injection signal to initiate the injection event at a first time, and to generate the ultrasonic actuation signal to initiate the ultrasonic exciter system to ultrasonically vibrate the fuel at a second time during the injection event and later than the first time.

2. The fuel system of claim 1, wherein the injection event has a first pulse width and the second time is at least 25% of the first pulse width from the first time.

3. The fuel system of claim 2, wherein the second time is in the range 25% to 50% of the first pulse width from the first time.

4. The fuel system of claim 1, wherein the injection event has a first pulse width and the ultrasonic actuation signal is applied to the ultrasonic exciter system to generate ultrasonic vibrations for a second pulse width, and the second pulse width is shorter than the first pulse width.

5. The fuel system of claim 4, wherein the second pulse width ends before the end of the first pulse width.

6. The fuel system of claim 4, wherein the second pulse width ends after the end of the first pulse width.

7. The fuel system of claim 1, the ultrasonic exciter system including an ultrasonic horn and the ultrasonic horn being positioned in the injector cavity immediately upstream of the nozzle housing.

8. A method of adjusting a fuel spray from a fuel injector into a combustion chamber of an internal combustion engine, the method comprising:

generating an injection signal and an ultrasonic actuation signal;

moving a nozzle valve element of the fuel injector at the beginning of the injection event and movement of the nozzle valve element is independent of the ultrasonic actuation signal;

receiving the injection signal and beginning an injection event at a first time in response to the injection signal;

receiving the ultrasonic actuation signal during the injection event, and generating ultrasonic vibrations in the fuel at a second time later than the first time in response to the ultrasonic actuation signal; and moving an ultrasonic exciter system at the second time while maintaining a position of the nozzle valve element.

9. The method of claim 8, wherein the injection event has a first pulse width and the second time is at least 25% of the first pulse width from the first time.

10. The method of claim 9, wherein the second time is in the range 25% to 50% of the first pulse width from the first time.

11. The method of claim 8, wherein the injection event has a first pulse width and the ultrasonic vibrations have a second pulse width, and the second pulse width is shorter than the first pulse width.

12. The method of claim 11, wherein the second pulse width ends before the end of the first pulse width.

13. The method of claim 8, wherein the fuel injector includes a plurality of injector orifices and the ultrasonic vibrations are generated in the fuel prior to flowing through the injector orifices.

14. The method of claim 8, the fuel injector including an ultrasonic horn that generates the ultrasonic vibrations in response to the ultrasonic actuation signal, a nozzle housing, and an injector cavity, and the ultrasonic horn being positioned in the injector cavity immediately upstream of the nozzle housing.

15. A method of adjusting a fuel spray from a fuel injector into a combustion chamber of an internal combustion engine, the method comprising:

generating an injection signal and an ultrasonic actuation signal;

moving a nozzle valve element of the fuel injector at the beginning of the injection event and movement of the nozzle valve element is independent of the ultrasonic actuation signal;

receiving the injection signal and beginning an injection event at a first time in response to the injection signal, the injection event having a first pulse width;

receiving the ultrasonic actuation signal and generating ultrasonic vibrations in response to the ultrasonic actuation signal, the ultrasonic vibrations beginning at a second time later than the first time and prior to the end of the first pulse width, and the ultrasonic vibrations having a second pulse width; and moving an ultrasonic exciter system at the second time while maintaining a position of the nozzle valve element.

16. The method of claim 15, wherein the second pulse width extends for at least 50% of the first pulse width.

17. The method of claim 15, wherein the second pulse overlaps the first pulse width for a maximum of 75% of the first pulse width.

18. The method of claim 15, wherein the second pulse width is shorter than the first pulse width.

19. The method of claim 18, wherein the second pulse width ends before the end of the first pulse width.

20. The method of claim 15, wherein the fuel injector includes a plurality of injector orifices and the ultrasonic vibrations are generated in the fuel prior to flowing through the injector orifices.

21. The method of claim 15, the fuel injector including an ultrasonic horn that generates the ultrasonic vibrations in response to the ultrasonic actuation signal, a nozzle housing, and an injector cavity, and the ultrasonic horn being positioned in the injector cavity immediately upstream of the nozzle housing.

* * * * *